United States Patent [19]

Yamada

[11] 4,270,764

[45] Jun. 2, 1981

[54] NOISEMAKER FOR SKATEBOARD

[76] Inventor: Carl S. Yamada, 1415 Victoria St., Apt. 308, Honolulu, Hi. 96822

[21] Appl. No.: 957,362

[22] Filed: Nov. 3, 1978

[51] Int. Cl.[3] ..... A63C 17/02

[52] U.S. Cl. ..... 280/87.04 A; 46/114; 280/1.14; 280/289 R; 280/809

[58] Field of Search ..... 280/289 R, 289 D, 1.14, 280/87.04 A, 11.1 R, 11.19, 11.37 E, 809; 301/5.3, 5.7, 63 P, 63 W, 37 R, 375 A; 46/114, 192, 111

[56] References Cited

U.S. PATENT DOCUMENTS

| | | | |
|---|---|---|---|
| 616,458 | 12/1898 | Fougereau | 280/1.14 X |
| 660,229 | 10/1900 | Stratton et al. | 116/56 |
| 1,604,381 | 10/1926 | Brown et al. | 46/114 |
| 2,578,682 | 12/1951 | Feinstrom | 46/191 |
| 2,788,612 | 4/1957 | Sametz | 46/191 |
| 3,233,361 | 2/1966 | Conaghan | 46/191 |
| 3,302,954 | 2/1967 | Elwell | 280/11.19 |
| 3,384,990 | 5/1968 | Romand | 46/191 |
| 3,827,178 | 8/1974 | Warneke | 46/191 |
| 4,018,450 | 4/1977 | Rutledge | 280/289 R |
| 4,152,001 | 5/1979 | Christianson | 280/87.04 A X |

FOREIGN PATENT DOCUMENTS

| | | | |
|---|---|---|---|
| 605818 | 7/1948 | United Kingdom | 46/114 |

*Primary Examiner*—John J. Love
*Assistant Examiner*—D. W. Underwood
*Attorney, Agent, or Firm*—Saidman & Sterne

[57] ABSTRACT

A noise-making device which is particularly adapted to be utilized in conjunction with a skateboard or similar wheeled vehicle. The device comprises a ring-shaped component having one or two cylindrical projections extending from the outer peripheral edge thereof in a direction parallel to the axis of the ring. The other side of the ring is fastened to the end wall of a rotatable wheel, such as a skateboard wheel. The other component of the device comprises a somewhat rectangular, flat piece of metal having a pair of rounded edges and a hole in the center. This component is fastened to the wheel support device so that an edge of the metal piece is adjacent the end surface of the wheel. As the wheel rotates, the projections from the rotating component intercept the stationary plate to flex same, thereby creating sound.

7 Claims, 8 Drawing Figures

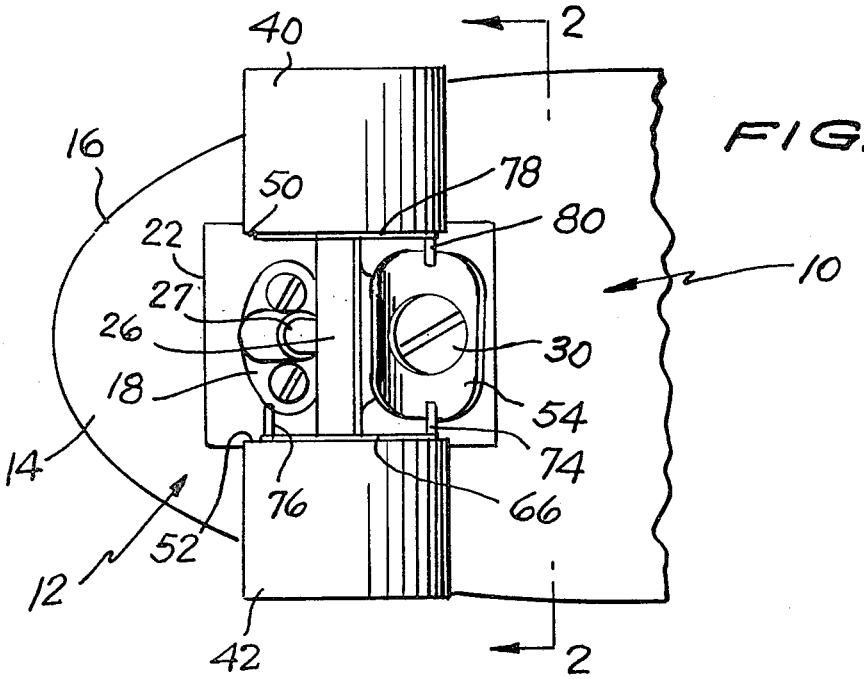
FIG. 1.
FIG. 2.
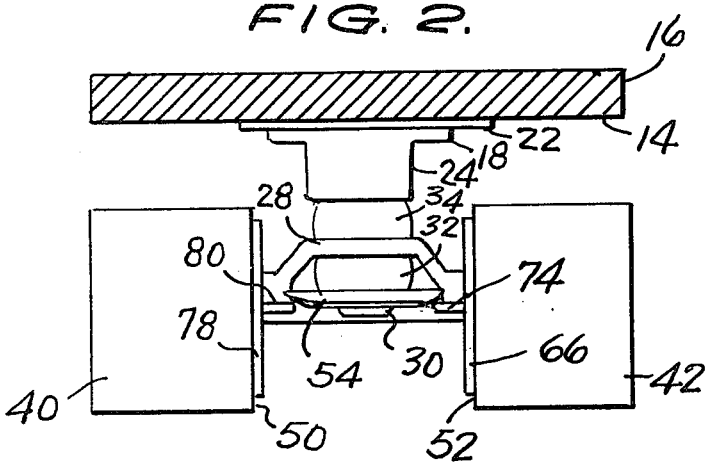
FIG. 7.
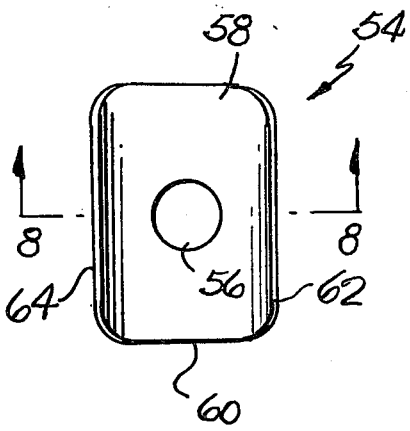
FIG. 8.
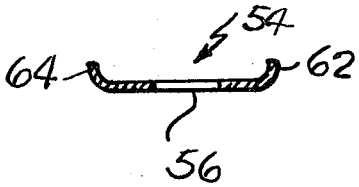
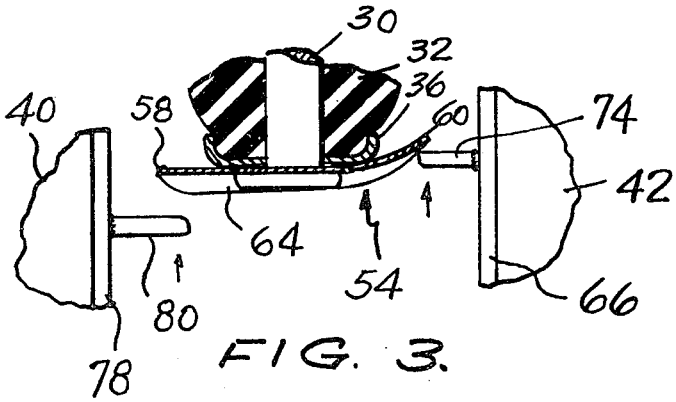
FIG. 3.

NOISEMAKER FOR SKATEBOARD

BACKGROUND OF THE INVENTION

1. Field of the Invention

The present invention is related to noise-making devices and, more particularly, is directed towards a noise-making device which is adapted to be utilized in connection with a wheeled toy.

2. Description of the Prior Art

Over the years, many noise-making devices have been suggested which are designed to be mounted to the wheel or wheels of a wheeled toy, such as a bicycle, roller skate, or the like.

In fact, I am aware of the following U.S. patents which are indicative of the state of the art in this area: U.S. Pat. Nos. 660,229; 2,578,682; 2,788,612; 3,233,361; 3,302,954; 3,384,990; 3,827,178; and 4,018,450.

While each of the devices described in the above-cited patents may be attractive for utilization in particular situations, I have found that, overall, the prior art devices are too complex, difficult to install, are subject to mechanical breakdown, are difficult to service, would be relatively expensive, and/or do not achieve the type of sound production which would attract a potential buyer.

Further, none of the devices described in the foregoing patents are particularly adapted to be utilized in combination with a skateboard. The booming popularity of the skateboard therefore provides a ready market for a simple, non-complex, inexpensive, durable, attractive and efficient noise-making device. It is towards providing same that the present invention is advanced.

OBJECTS AND SUMMARY OF THE INVENTION

It is therefore a primary object of the present invention to provide a new and useful noise-making device which is particularly adapted to be utilized with a skateboard, and which overcomes all of the disadvantages noted above with respect to the prior art devices.

Another object of the present invention is to provide a novel and unique noisemaker for a wheeled toy which is simple, non-complex, inexpensive, durable, may be readily installed and serviced, and which is attractive and pleasing to a user.

An additional object of the present invention is to provide a noisemaker for a wheeled toy which may be readily mass produced in large quantity, which may be easily adapted to existing skateboards and other similar toys, and which therefore may be manufactured inexpensively and in a manner which would appeal to a large segment of skateboard enthusiasts.

The foregoing and other objects are attained in accordance with one aspect of the present invention through the provision of a noisemaker for a toy having a wheel and means for supporting the wheel for rotation, which comprises plate means connected to the supporting means, and projection means connected to the wheel for rotating therewith and adapted to contact and thereby flex the plate means at least once per revolution to thereby create noise.

In accordance with one aspect of the present invention, the plate means comprises a thin, substantially planar metallic plate positioned substantially parallel to the axis of rotation of the wheel. The plate may further include forward and rear substantially parallel edges which are curved to increase the resiliency thereof. The plate further includes a substantially linear side edge connecting the forward and rear edges and which is substantially perpendicular to the axis of rotation of the wheel. The side edge is positioned so as to be intercepted and thereby flexed by the projection means. The toy typically includes a second wheel rotating about the axis which may include second projection means connected thereto, the plate including a second side edge parallel to the first side edge and positioned so as to be intercepted and thereby flexed by the second projection means.

In accordance with another aspect of the present invention, the wheel is mounted for rotation about an axle and includes a substantially flat end surface perpendicular to the axle, the projection means being mounted to the end surface. More particularly, the projection means preferably comprises at least one substantially cylindrical pin or stud extending from the end surface, preferably perpendicularly, a distance sufficient to intercept the plate means upon rotation of the wheel. The projection means further comprises a substantially flat base member fastened to the end surface of the wheel. A central aperture is formed in the base member through which the axle extends, and the pin extends from the outer surface of the flat base member. The base member may include a plurality of pins extending from the outer surface, each of which is adapted to intercept the plate means once per revolution of the wheel. The toy typically includes a second wheel mounted for rotation about the same axle and being substantially identical to the first wheel. A second projection means may be connected to the end surface of the second wheel so as to intercept the same plate means at least one time per revolution of the second wheel.

In accordance with yet another aspect of the present invention, the toy may comprise a skateboard, and the means for supporting the wheel then comprises a wheeled skateboard truck having a king pin and an axle bushing oriented perpendicularly to the king pin. The plate means in this embodiment is secured to the truck by the king pin so as to be substantially perpendicular thereto and extending laterally almost the entire width of the axle bushing.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 1 is a bottom view of one end of a wheeled skateboard which illustrates a preferred embodiment of the present invention;

FIG. 2 is a cross-sectional view of the skateboard illustrated in FIG. 1 and taken along line 2—2 thereof;

FIG. 3 is an enlarged, broken and partly sectional view illustrating the preferred embodiment of the present invention in operation;

FIG. 7 is a plan view of a preferred embodiment of another component of the present invention; and FIG. 8 is a cross-sectional view of the component illustrated in FIG. 7 and taken along line 8—8 thereof.

DETAILED DESCRIPTION OF THE PREFERRED EMBODIMENT

Figure 4:
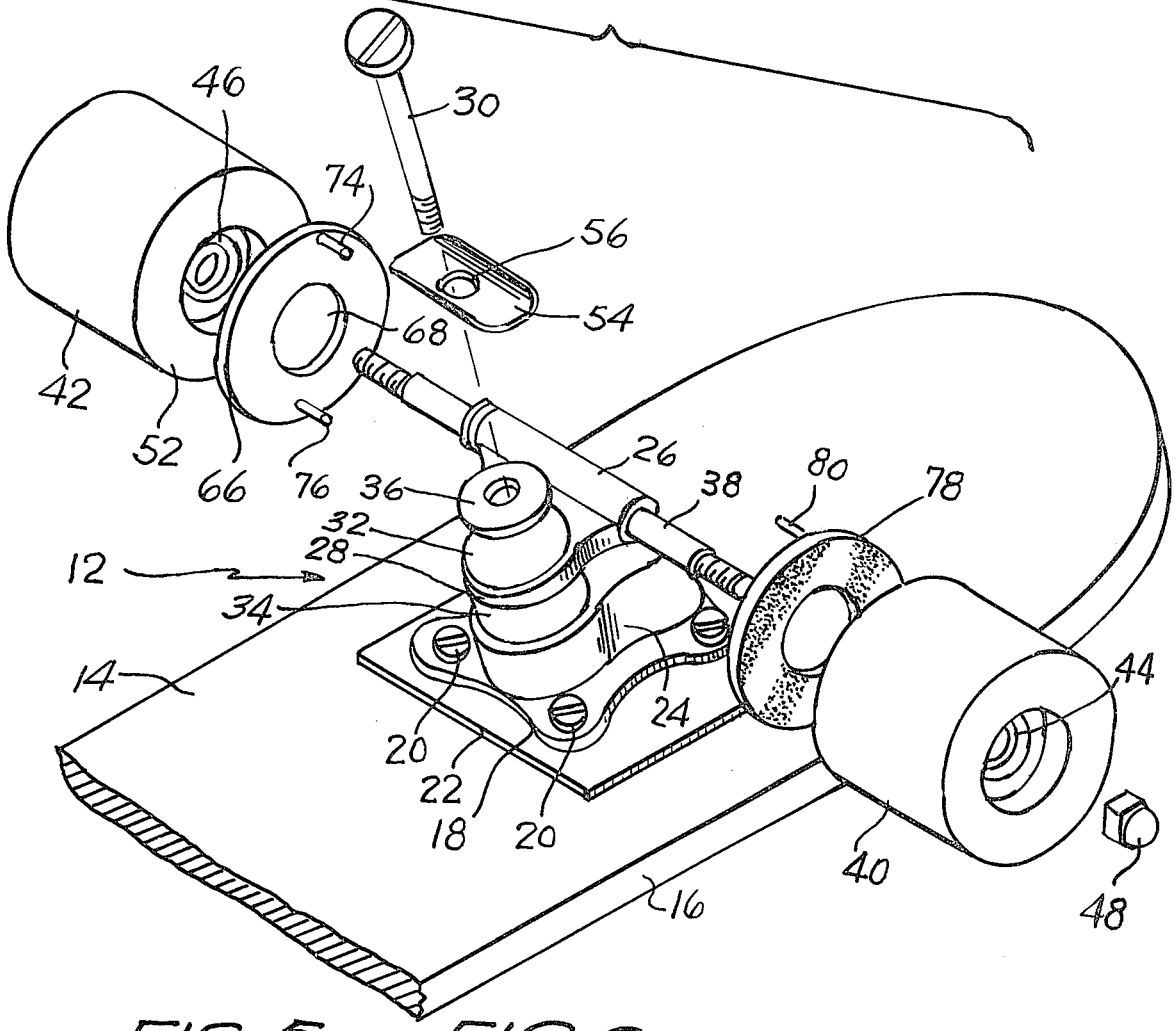
FIG. 4 is a perspective, exploded view which illustrates the preferred construction and mounting of the present invention on the skateboard of FIG. 1.

Referring to the drawings, wherein like reference numerals represent identical or corresponding parts throughout the several views, and more particularly to FIGS. 1, 2 and 4 thereof, a preferred embodiment of the noise-making device of the present invention is indicated generally by reference numeral 10. Noisemaker 10 is illustrated and will be described hereinafter as mounted to the wheeled truck 12 of a skateboard 16, although it will be understood by a person of ordinary skill in the art that the noisemaker 10 may be mounted to other wheeled structures. The specific components and operation of noisemaker 10 will be described in greater detail hereinafter.

The wheeled truck of the skateboard is indicated generally by reference numeral 12 and is shown fastened to the underside 14 of the front or rear end of a skateboard 16. In this regard, the noisemaker 10 of the present invention may be utilized in conjunction with either the front truck, rear truck, or both, of skateboard 16. However, for the purpose of description and explanation, only one such truck 12 need be illustrated and described.

The wheeled truck 12 is standard and well-known in the skateboard art and typically comprises a mounting plate 18 which is secured to the underside 14 of board 16 by, for example, screws 20. A shock-absorbing cushion 22 may be interposed between plate 18 and underside 14.

Extending from the mounting plate 18 is an axle support base 24 from one end of which angularly extends a bushing support rod 27 (FIG. 1). Bushing support rod 27 terminates in an axle bushing 26 which includes a round, apertured flange 28 extending laterally therefrom.

The apertured flange 28 is secured to axle support base 24 by a threaded bolt 30 which is sometimes known in the skateboard art as a king pin. The king pin 30 is received by threads formed in base 24.

A pair of shock-absorbing resilient washers 32 and 34 are positioned one on each side of apertured flange 28, and a flat steel retaining washer 36 is normally positioned between resilient washer 32 and the head of king pin 30.

Extending through axle bushing 26 is an axle 38 having threaded ends for mounting a pair of wheels 40 and 42 thereon. The wheels 40 and 42 may be manufactured of any suitable material, and normally include roller bearings 44 and 46 therewithin. A nut 48 secures the wheel 40 to axle 38. It should be noted that each wheel 40 and 42 includes an inner, ring-shaped end surface 50 and 52, respectively, which are substantially parallel to one another and are perpendicular to the axis of axle 38.

The foregoing structure of wheeled truck 12 is standard and does not constitute the present invention.

The noisemaker 10 of the present invention includes two separate and distinct components, one of which rotates with a wheel, the other of which is stationary. The stationary component is illustrated with greater particularity in FIGS. 7 and 8 and is seen to comprise a thin metal flexible plate 54 having a mounting aperture 56 formed centrally therein. Plate 54 preferably includes straight side edges 58 and 60 which define the width of plate 54 as extending almost the entire width of axle bushing 26, as will become apparent hereinafter. Plate 54 also preferably includes curved front and rear edges 62 and 64 for added resiliency, as will be explained hereinafter.

In a preferred embodiment, the plate 54 is on the order of one and three-fourths inches long and one and one-fourth inches wide, and may be constructed of the same type and thickness of aluminum material presently utilized, for example, in soft drink cans.

As is clear from FIGS. 1 and 4, the plate 54 is secured to the truck 12 by positioning aperture 56 adjacent washer 36 and resecuring king pin 30 therethrough. The curved front and rear edges 62 and 64 are oriented parallel to the axle 38 of wheels 40 and 42, while the side edges 58 and 60 extend almost the entire width of bushing 26 to a position just slightly spaced from inner end surfaces 50 and 52 of wheels 40 and 42, respectively.

Figure 5:
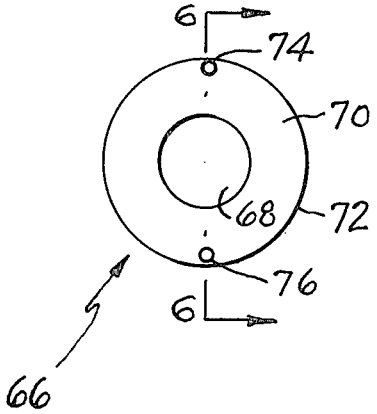
FIG. 5 is a plan view of a preferred embodiment of one of the components of the present invention.
Figure 6:
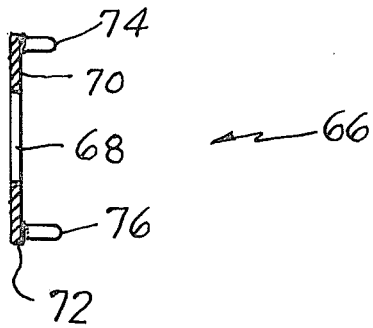
FIG. 6 is a cross-sectional view of the component illustrated in FIG. 5 and taken along line 6—6 thereof.

The moving component of the noisemaker 10 of the present invention is illustrated in FIGS. 5 and 6. In a preferred form, the moving component comprises a ring member 66 having an outer diameter no larger than that of wheel 42, for example. Ring member 66 includes a center aperture 68 through which the axle 38 of truck 12 may be positioned. The ring member 66 is preferably substantially planar and includes an outside surface 70 having a peripheral portion 72. Either one or two projections 74 and/or 76 are preferably mounted on the periphery 72 and extend perpendicularly from the outside surface 70 of ring member 66. Projections 74 and 76 preferably take the form of substantially cyclindrical studs or pins which may be, for example, on the order of an eighth of an inch in diameter and 9/32 inch high. As mentioned above, either one, two or a plurality of such projections may be provided, as may be desired. Preferably, however, only one or two projections 74 and/or 76 need be provided to create the desirable sounds in accordance with the present invention. The projections 74 and 76 may be secured to the outer surface 70 of ring member 66 by any suitable means, such as by welding or soldering, and are preferably formed of metal.

As illustrated in FIGS. 1–4, ring member 66 having two studs 74 and 76 may be secured to the end surface 52 of wheel 42. On the end surface 50 of the other wheel 40 may be provided an additional ring member 78 which may have, for example, a single projection 80 extending therefrom.

The length of projections 74, 76 and 80, and the span of plate 54 are chosen so that the studs 74, 76 and 80 overlap the side edges 58 and 60 of plate 54.

Therefore, in operation, as the wheels 40 and 42 rotate, the projections 74, 76 and 78 will come into contact with, flex, and procede past the plate member 54. The manner of flexing of plate 54 in response to contact by stud 74 is illustrated in greater detail in FIG. 3, from which it may be appreciated that the curved front and rear edges 62 and 64 of plate 54 add to the natural resiliency of the plate.

A unique tacking sound is produced by the present invention and is believed to result both from the contacting of the plate by the projections, as well as by the flexing of the plate.

Obviously, numerous modifications and variations of the present invention are possible in light of the above teachings. For example, as mentioned above, the ring members may be applied to all four wheels of a skateboard, or to the two front or two rear wheels, or to any combination thereof. One, two or more studs may be provided on each ring member, in any desired combination. Therefore, I wish it to be understood that I do not desire to be limited to the exact details of construction shown and described, for obvious modifications will occur to a person of ordinary skill in the art.

I claim as my invention:

1. A noisemaker for a toy having a wheel and means for supporting said wheel for rotation, which comprises:

plate means connected to said supporting means; and projection means connected to said wheel for rotating therewith and adapted to contact and thereby flex said plate means at least once per revolution to thereby create noise, wherein said plate means comprises a thin, substantially planar metallic plate positioned substantially parallel to the axis of rotation of said wheel, and wherein said plate further comprises forward and rear substantially parallel edges which are curved along their respective lengths away from the plane of said plate.

2. The noisemaker as set forth in claim 1, wherein said plate includes a substantially linear side edge connecting said forward and rear edges and being substantially perpendicular to said axis, said side edge positioned so as to be intercepted and thereby flexed by said projection means.

3. A noisemaker for a toy having a wheel and means for supporting said wheel for rotation, which comprises:

plate means connected to said supporting means; and projection means connected to said wheel for rotating therewith and adapted to contact and thereby flex said plate means at least once per revolution to thereby create noise, wherein said plate means comprises a thin, substantially planar metallic plate positioned substantially parallel to the axis of rotation of said wheel, forward and rear substantially parallel edges, and a substantially linear side edge connecting said forward and rear edges and being substantially perpendicular to said axis, said side edge positioned so as to be intercepted and thereby flexed by said projection means, and wherein said toy includes a second wheel rotating about said axis and having second projection means connected thereto, said plate including a second side edge substantially parallel to the other side edge and positioned so as to be intercepted and thereby flexed by said second projection means to thereby create additional noise.

4. A noisemaker for a toy having a wheel and means for supporting said wheel for rotation, which comprises:

a substantially planar flexible single plate connected to said supporting means; and projection means connected to said wheel for rotating therewith and adapted to contact and thereby flex said plate at least once per revolution to thereby create noise, wherein said wheel is mounted for rotation about an axle and includes a substantially flat end surface perpendicular to said axle, said projection means being mounted to said end surface, and wherein said projection means comprises at least one pin extending from said end surface a distance just sufficient to intercept and thereby flex the edge of said plate upon rotation of said wheel;

wherein said projection means further comprises a substantially flat base member fastened to said end surface of said wheel and including a central aperture through which said axle extends, said at least one pin extending from the outer surface of said flat base member; and wherein said base member further includes a plurality of pins extending from said outer surface, each of which is adapted to intercept said single plate once per revolution of said wheel, wherein said toy includes a second wheel mounted for rotation about said axle and being substantially identical to the outer wheel, a second projection means being connected to the end surface of said second wheel so as to intercept said plate at least one time per revolution of said second wheel.

5. A noisemaker for a toy having a wheel and means for supporting said wheel for rotation, which comprises:

a substantially planar flexible plate connected to said supporting means; and projection means connected to said wheel for rotating therewith and adapted to contact and thereby flex said plate at least once per revolution to thereby create noise, wherein said toy comprises a skateboard or a similar wheeled vehicle, and said means for supporting said wheel comprises a wheeled truck having a king pin for fastening said plate to said supporting means and an axle bushing oriented perpendicularly thereto.

6. The noisemaker as set forth in claim 5, wherein said plate means is secured to said truck by said king pin so as to be substantially perpendicular thereto and extending laterally almost the entire width of said axle bushing.

7. Apparatus, which comprises:

a skateboard or a similar wheeled vehicle having a truck fastened to the underside thereof;

said truck including rotatable wheels coupled to an axle, means for supporting said axle for rotation and bolt means for connecting said supporting means to said truck; and noisemaking means connected to said truck for making noise as said wheels rotate, said noisemaking means including a substantially planar resilient plate having a side edge, said plate being fastened to said truck by said bolt means, and at least one projection connected to one of said wheels so as to extend from said wheel slightly beyond said side edge of said plate for flexing said plate at least once per revolution of said wheels to thereby make noise.

* * * * *